United States Patent [19]

Moore

[11] Patent Number: 4,836,112

[45] Date of Patent: Jun. 6, 1989

[54] HYDRAULIC INCHING DRIVE SYSTEM

[75] Inventor: Andrew L. Moore, Chicago, Ill.

[73] Assignee: Rockwell International Corporation, Pittsburgh, Pa.

[21] Appl. No.: 158,244

[22] Filed: Feb. 19, 1988

[51] Int. Cl.[4] ..... B41L 1/02

[52] U.S. Cl. ..... 101/486; 101/248

[58] Field of Search ..... 101/248, 426, 216, 219, 101/220, 179, 180, 181, 485, 486; 74/333, 343, 810, 395, 396, 412 R

[56] References Cited

U.S. PATENT DOCUMENTS

| | | | |
|---|---|---|---|
| 2,219,734 | 10/1940 | Barber . | |
| 2,863,387 | 12/1958 | Huffman | 101/248 |
| 2,948,216 | 8/1960 | Thompson | 101/248 |
| 3,191,531 | 6/1965 | Worthington et al. . | |
| 3,398,681 | 8/1968 | Hirose . | |
| 3,565,006 | 2/1971 | Stewart | 101/248 |
| 3,641,933 | 2/1972 | Tafel | 101/248 |
| 3,717,092 | 2/1973 | Crum | 101/248 |
| 3,724,368 | 4/1973 | Treff | 101/248 |
| 3,732,815 | 5/1973 | Greiner et al. | 101/220 |
| 3,742,849 | 7/1973 | Greiner et al. | 101/220 |
| 3,742,850 | 7/1973 | Sedlak | 101/248 |
| 3,793,899 | 2/1974 | Bourbonnaud | 74/397 |
| 3,841,216 | 10/1974 | Huffman | 101/248 |
| 4,072,104 | 2/1978 | Schaffer | 101/248 |
| 4,183,296 | 1/1980 | Rambausek . | |
| 4,207,815 | 6/1980 | Watanabe | 101/216 |
| 4,214,526 | 7/1980 | Jeschke . | |
| 4,240,346 | 12/1980 | Landis et al. . | |
| 4,350,093 | 9/1982 | Ishii | 101/248 |
| 4,394,835 | 7/1983 | Gertsch et al. . | |
| 4,398,464 | 8/1983 | Morbitzer et al. . | |
| 4,572,074 | 2/1986 | Guaraldi | 101/248 |
| 4,573,408 | 3/1986 | Bezler | 101/248 |
| 4,706,566 | 11/1987 | Kishine et al. | 101/426 |

FOREIGN PATENT DOCUMENTS

| | | | |
|---|---|---|---|
| 2354519 | 10/1973 | Fed. Rep. of Germany | 101/248 |
| 704137 | 2/1954 | United Kingdom | 101/248 |
| 2028234 | 3/1980 | United Kingdom | 101/248 |
| 2120976 | 12/1983 | United Kingdom | 101/248 |

*Primary Examiner*—Eugene H. Eickholt

[57] ABSTRACT

An inching drive mechanism which affords the capability of rotating the plate and blanket cylinders of a printing press in an automated fashion by utilizing a hydraulically powered motor, a gear train and a pneumatic clutch. The hydraulic motor produces torque which is transmitted via the gear train to the pneumatic clutch. When the pneumatic clutch is engaged, the torque is transmitted to and rotates the plate and blanket cylinders of the printing press.

8 Claims, 2 Drawing Sheets

HYDRAULIC INCHING DRIVE SYSTEM

FIELD OF THE INVENTION

This invention relates generally to a rotary printing press drive system. More particularly it relates to a novel drive mechanism which permits the low speed rotation of the plate and blanket cylinders of a disengaged printing press unit in an automated fashion.

BACKGROUND OF THE INVENTION

Printing presses, such as those used for printing newspapers and the like, utilize plates which have the particular impression to be printed etched on them. These plates are attached to a portion of the printing press known as a plate cylinder. When printing newspapers and the like, these plates will need to be changed several times a day in order to reflect the different editions or different newspapers printed on each printing press unit.

Heretofore, in order for a plate to be removed and changed on a plate cylinder, the press unit would have to be disengaged from the press drive system or the entire printing press stopped. With the press unit disengaged, the plate could then be removed from or placed on the plate cylinder by engaging in an activity known as "barring."

Barring is the common way to rotate a plate cylinder and remove or replace a particular plate. Barring consists of manually disengaging a press unit, inserting a metal bar in the gaps found beside the plate cylinder and using the bar as a lever to manually rotate the cylinder at a low speed. Thus, a pressman will "inch" the plate cylinder a fraction of a rotation, engage in the specific activity that required disengagement of the press unit (usually changing the plate), and repeat this process until the plate cylinder is fully rotated. This barring process is obviously very labor intensive, as well as time consuming.

If a press unit is not disengaged from the main drive of the printing press, all of the plates on the press units must be changed simultaneously. Under such circumstances, several pressmen simultaneously must remove and replace plates on each individual press unit in the entire press while the entire press is driven at extremely low inching speeds. Naturally, this activity results in a great disruption of pressroom activities.

The inching drive mechanism of the present invention overcomes the foregoing disadvantages by allowing each individual press unit to be disengaged from the entire press drive system, and simultaneously allowing each disengaged unit to be rotated by a low speed motor.

SUMMARY OF THE PRESENT INVENTION

It is an object of the present invention to provide an inching drive mechanism within a rotary printing press drive system which is designed to provide for individual press unit control and to facilitate the addition or removal of plates from plate cylinders.

It is another object of the present invention to provide a drive mechanism which can be operated in forward and reverse directions;

It is another object of the present invention to provide a drive mechanism which is compatible for use on a variety of different types of printing presses.

It is still another object of the present invention to provide a drive mechanism which will not require high voltage AC or DC electrical power.

It is yet another object of the present invention to provide a drive mechanism which will allow for the efficient utilization of the auto-engagement feature of a main printing press drive system.

It is another object of the present invention to provide a drive mechanism which is a labor and time saving device.

It is still another object of the present invention to provide a drive mechanism which is simple in construction.

It is a still further object of the present invention to provide a drive mechanism which is compact and inexpensive to manufacture.

Generally, the objects of the present invention are accomplished through a drive mechanism which includes a mechanical power source capable of producing rotational output in either direction, a means for transmitting power which is operatively engaged to the mechanical power source, and a clutch system operatively connected to the power transmitting means and capable of engaging and disengaging the drive mechanism.

In the preferred embodiment, the inching drive mechanism's main components are a hydraulically powered motor, a gear train and a pneumatic clutch system. When the printing press is in the operational mode, the inching drive mechanism is disengaged. When the inching drive mechanism is operational, the plate and blanket cylinder gears are disengaged from the drive train of the printing press and engaged with the drive train of the inching drive mechanism. Mechanisms for disengaging the plate and blanket cylinders from the drive train of a printing press are known in the art.

When the inching drive system is utilized, a pressman will simply disengage the plate and blanket cylinders for the individual unit from the drive system of the printing press, and then press a button to engage the inching drive mechanism. The pressman can then proceed to remove and replace plates from the plate cylinders while the drive mechanism rotates the plate cylinders at extremely low speeds. The plates on each printing press unit need not be changed simultaneously, nor does the pressman need to engage in "barring". Therefore, the present invention provides for efficiency in labor and time saving over what is currently known in the art.

The inching drive mechanism also allows for the utilization of any auto-engagement feature. Although the auto-engagement feature on a printing press is old in the art, the present invention provides for its efficient utilization.

The auto-engagement feature on a printing press functions to transfer the applied torque from the inching drive mechanism back to the drive system of the main printing press. This transfer is accomplished through a single position clutch which is in the disengaged portion of the press unit while the inching drive mechanism may be operational, but which is in the engaged portion of the press unit when the inching drive mechanism is disengaged.

To enable the auto-engagement system, the inching drive system of the present invention drives the plate and blanket cylinders at a low speed, which in turn drives an idler gear which is connected to the single position clutch. At the low rotating speed, the single position clutch engages, thus allowing the clutch plates to slide slowly against each other. As the single position clutch reaches a second position, it becomes fully engaged. At this point, limit switches disengage the inching drive mechanism and transfer operation over to the main printing press drive system.

BRIEF DESCRIPTION OF THE DRAWINGS

The accompanying drawings, which are incorporated in and constitute part of the specification, illustrate embodiments of the invention and, together with the description, serve to explain the principles of the invention.

Figure 3:
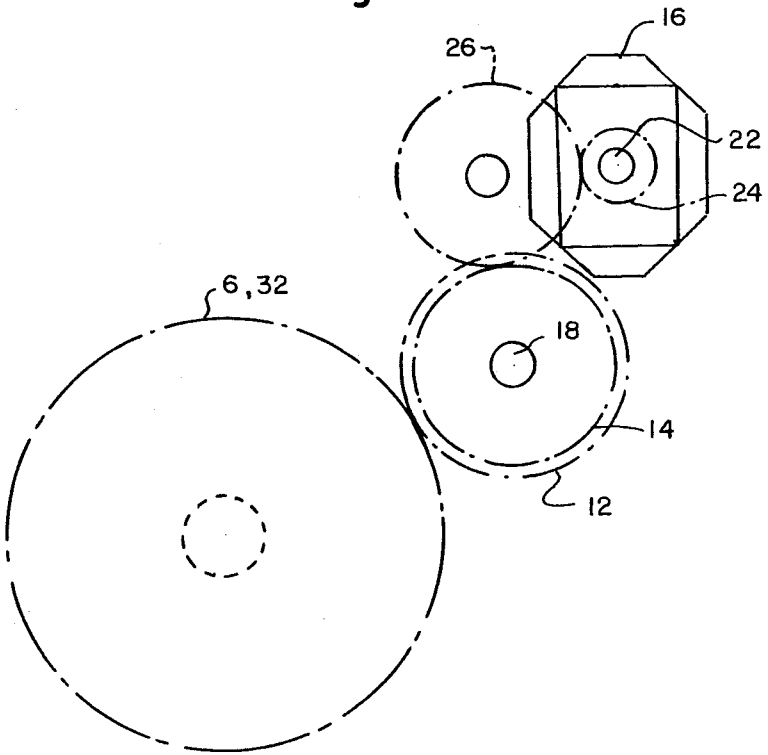
FIG. 3 is an exploded, schematic view showing the gear connections of the inching drive mechanism and the plate cylinder.

The invention described in this specification and shown in the drawings utilizes certain principles and/or concepts as set forth herein and in the claims. Those skilled in the graphic printing art will realize that these principles and/or concepts are capable of being utilized in a variety of embodiments which may differ from the exact embodiments utilized herein for illustrative purposes. For this reason, the present invention is not to be construed as being solely limited to the illustrative embodiments.

DETAILED DESCRIPTION OF THE PREFERRED EMBODIMENTS

Figure 1:
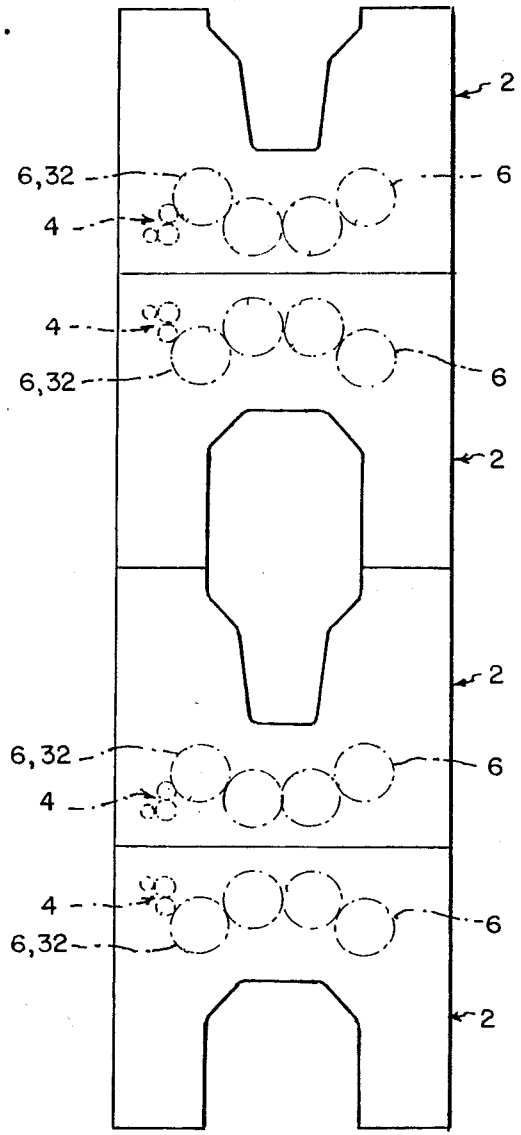
FIG. 1 is a side elevation view of individual press units showing the general location of the plate cylinders and inching drive mechanisms.

Referring now to FIG. 1, individual press units 2 are shown, each having an inching drive mechanism 4 of the present invention and plate cylinders 6.

Figure 2:
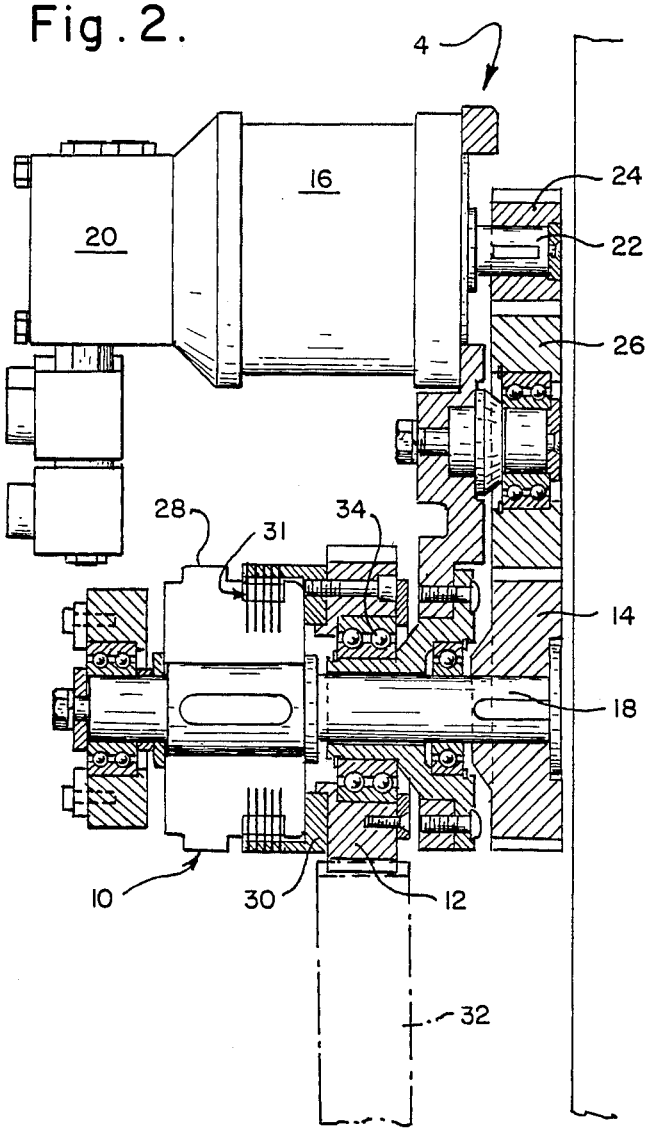
FIG. 2 shows a sectional view of the inching drive mechanism.

Turning now to FIG. 2 and FIG. 3, and using like numbers to designate like items to assist in understanding the views, the inching drive mechanism 4 and plate cylinder 6 are shown schematically.

The main components of the inching drive mechanism are hydraulically powered motor, a gear train, and a pneumatic clutch system. When the printing press is in the operational mode, the inching drive mechanism is disengaged. When the inching drive mechanism is operational, the plate and blanket cylinder gears are disengaged from the printing press drive train and engaged with and rotated by the inching drive mechanism.

When the inching drive mechanism 4 is ready to be activated, the plate cylinders 6 are disconnected from the printing press drive system. A button is pushed on the control panel of the printing press which thereafter sounds an alarm indicating that the inching drive mechanism is about to be engaged. Pneumatic pressure is applied to the clutch 10 when the inching drive mechanism 4 engages. This pressure, in turn, engages the clutch. When the clutch is engaged, the helical output gear 12, shown in FIGS. 2 and 3, no longer operates as an idler gear as it does when the press is in normal operation. Instead, output gear 12 becomes engaged via the clutch system. The torque transmitted by shaft gear 14 when the motor 16 is engaged and the gear train is in motion is transmitted via clutch shaft 18 to output gear 12.

Shortly after the inching drive mechanism 4 is activated, the hydraulic motor 16 begins operation. The hydraulic motor 16 obtains its power through the application of pressurized hydraulic fluids to the motor. A hydraulic motor 16 is utilized in the present invention because such a motor is capable of variable speeds unlike an AC motor and will achieve relatively high torque output at low speeds while still remaining small in size and weight, unlike a DC servo motor. Obviously, while a hydraulic motor is used in this preferred embodiment, any variable speed motor system can be utilized. Likewise, while a pneumatic clutch is first engaged in the inching drive mechanism, other clutches or means for engaging and disengaging the inching drive mechanism can be utilized. Hydraulic fluid is applied to the hydraulic motor 16 through the hydraulic control valve 20. The hydraulic control valve 20 is actuated electrically. The application of hydraulic fluid to the hydraulic motor 16 causes a low-speed/high-torque output at the motor shaft 22 which extends from the motor. The motor shaft 22 of the hydraulic motor 16 is connected to the motor gear 24. The motor gear 24 is a spur gear which transmits the torque from the hydraulic motor 16 to the inching drive mechanism's gear train consisting of motor gear 24, idler gear 26 and shaft gear 14.

The motor gear 24 is connected to an idler spur gear 26. The idler spur gear 26 in turn transmits torque to the shaft gear 14. Shaft gear 14 is keyed to the clutch shaft 18. Clutch shaft 18 is in turn keyed to the clutch housing 28. When pneumatic pressure is applied and the clutch 10 is engaged, torque from clutch shaft 18 is transmitted through the clutch 10 to the driving cup 30. The driving cup 30 comprises: a series of projections or teeth attached in conjunction with a hollowed out cup-shaped housing. The teeth are interleaved between the housing of the driving cup and the clutch 10 such that when the clutch 10 is disengaged, the teeth of the driving cup 30 spin freely. When the clutch 10 is engaged, the teeth of the driving cup 30 are driven by the clutch plates 31. The friction generated from these clutch plates 31 pressing together transfers torque from the clutch 10 to the driving cup 30. The driving cup 30 is, in turn, attached to the output gear 12. Thus, the torque transmitted from the hydraulic motor 16, as reduced by the gear train consisting of motor gear 24, idler gear 26 and shaft gear 14, is transmitted through the clutch shaft 18 to the clutch 10. When clutch 10 is engaged, the torque is then transmitted, via the pressing together of the clutch plates 31 of the clutch 10 from the clutch shaft 18 to the clutch 10 to the driving cup 30 and subsequently to the output gear 12. The output gear 12, in turn, engages a gear 32 attached to the plate cylinder 6, and transmits the low-speed/high-torque output of the gear train to the plate cylinder gear 32. The plate cylinder gear 32 is directly attached to the plate cylinder 6. Thus, the rotation of the plate cylinder gear 32 at low speed would likewise rotate the plate cylinder 6 at the same low speed. Thus, the inching drive function is achieved.

The plate cylinder gear 32 engages a series of gears within the press unit itself, namely, the blanket cylinder gear, the opposing blanket cylinder gear, and finally the opposing plate cylinder gear. The details of this gearing arrangement are not an important part of the present invention and are not shown in the drawings. Thus, the entire cylinder system of a printing press is inched forward or reverse. The variable speed of the hydraulic motor 16 allows a pressman to control the inching speed of all of the plate and blanket cylinders.

It should also be noted that the output gear 12 which engages plate cylinder gear 32 remains engaged with plate cylinder gear 32 whether or not the inching drive mechanism 4 is engaged. When the inching drive mechanism 4 is not engaged, the clutch 10 is disengaged and the output gear 12 spins freely, independent of the inching drive mechanism. When the inching drive mechanism 4 is disengaged, no torque is transmitted to output gear 12, and output gear 12 spins freely on a system of bearings 34.

What is claimed is:

1. A method of rotating a plate cylinder in a printing press, said method comprising the steps of:

providing means for transmission of power, said power transmission means including a transmission input member and a transmission output member and a plurality of gear members therebetween;

providing power input means operatively coupled to said transmission input member, said power input means including an electrically actuated hydraulic motor and a hydraulic control valve mounted on and operatively connected to said hydraulic motor;

providing power output means operatively coupled to said plate cylinder, said power output means including a driving cup member and an output gear member, said driving cup member being fixedly mounted to said output gear member, said driving cup member including a plurality of tooth members and an annular housing;

providing clutch system means for driving engagement of said transmission output member with said power output means, said clutch system means including at least one clutch plate member, a clutch housing enclosing said clutch plate member, a clutch shaft having a first end fixedly mounted to said clutch housing and a second end operatively connected to said transmission output member;

activating said hydraulic motor;

transmitting power from said hydraulic motor to said transmission input member;

transmitting power through said power transmission means to said transmission output member;

engaging said clutch system means; and, transmitting power from said transmission output member to said power output means.

2. In as printing press having at least one plate cylinder, inching means for driving said plate cylinder to permit the replacement of plates, and drive train means for driving said plate cylinder, said inching means operating independent of said drive train means, said inching means comprising:

means for transmission of power, said power transmission means including a transmission input member and a transmission output member and a plurality of spur gear members operatively connected in series relationship therebetween;

power input means operatively coupled to said transmission input member, said power input means including an electrically actuated hydraulic motor and a hydraulic control valve mounted on and operatively connected to said hydraulic motor;

power output means operatively coupled to said plate cylinder, said power output means including a driving cup member and an output gear member, said driving cup member being fixedly mounted to said output gear member, said driving cup member including a plurality of tooth members and annular housing; and, clutch system means for driving engagement of said transmission output member with said power output means, said clutch system means including at least one clutch plate member, a clutch housing enclosing said clutch plate member, a clutch shaft having a first end fixedly mounted to said clutch housing and a second end operatively connected to said transmission output member.

3. An inching drive mechanism for driving a plate cylinder in a printing press to permit the replacement of plates, said inching drive mechanism comprising:

means for transmission of power, said power transmission means including a transmission input member and a transmission output member and a plurality of gear members therebetween;

power input means which includes a hydraulic motor, a hydraulic control valve operatively connected to said hydraulic motor, and a driveshaft member having a first-end fixedly mounted to said hydraulic motor and a second-end operatively connected to said transmission input member;

power output means engageable with a plate cylinder; and, clutch system means for driving engagement of said transmission output member with said power output means.

4. The inching drive mechanism of claim 3 wherein said hydraulic control valve includes means for variable control of said hydraulic motor.

5. The inching drive mechanism of claim 3 wherein said clutch system means includes at least one clutch plate member, a clutch housing enclosing said clutch plate member, and a clutch shaft having a first end fixedly mounted to said clutch housing and a second end operatively connected to said transmission output member.

6. The inching drive mechanism of claim 3 wherein said power output means includes a driving cup member and an output gear member, said driving cup member being fixedly mounted to said output gear member.

7. The inching drive mechanism of claim 3 wherein said driving cup member further comprises a plurality of tooth members and an annular housing, said tooth members being fixedly mounted to said annular housing.

8. The inching drive mechanism of claim 3 wherein said plurality of gear members of the power transmission means is a gear train, said gear train including a motor gear, an idler gear and a shaft gear in series relationship in said gear train.

* * * * *